US011177571B2

(12) United States Patent
Liu et al.

(10) Patent No.: US 11,177,571 B2
(45) Date of Patent: Nov. 16, 2021

(54) PHASED ARRAY ANTENNA WITH EDGE-EFFECT MITIGATION

(71) Applicant: RAYTHEON COMPANY, Waltham, MA (US)

(72) Inventors: David Liu, Amherst, NH (US); Kenneth S. Komisarek, Manchester, NH (US); John Yorko, Lancaster, MA (US)

(73) Assignee: RAYTHEON COMPANY, Waltham, MA (US)

( * ) Notice: Subject to any disclaimer, the term of this patent is extended or adjusted under 35 U.S.C. 154(b) by 4 days.

(21) Appl. No.: 16/662,700

(22) Filed: Oct. 24, 2019

(65) Prior Publication Data

US 2021/0044020 A1 Feb. 11, 2021

Related U.S. Application Data

(60) Provisional application No. 62/883,833, filed on Aug. 7, 2019.

(51) Int. Cl.
*H01Q 9/04* (2006.01)
*H01Q 21/06* (2006.01)
*H01Q 1/52* (2006.01)

(52) U.S. Cl.
CPC ..... *H01Q 9/0414* (2013.01); *H01Q 1/523* (2013.01); *H01Q 21/062* (2013.01); *H01Q 21/065* (2013.01)

(58) Field of Classification Search
CPC .. H01Q 9/0414; H01Q 9/0457; H01Q 21/065; H01Q 21/22
See application file for complete search history.

(56) References Cited

U.S. PATENT DOCUMENTS 6,211,824 B1 * 4/2001 Holden ..... H01Q 1/523 343/700 MS
6,404,404 B1 * 6/2002 Chen ..... H01Q 21/0025 343/844
6,448,937 B1 9/2002 Aiken et al.
6,795,020 B2 * 9/2004 Sreenivas ..... H01Q 1/38 343/700 MS
6,856,297 B1 2/2005 Durham et al.
6,876,336 B2 4/2005 Croswell et al.
7,009,570 B2 3/2006 Durham et al.
(Continued)

FOREIGN PATENT DOCUMENTS

CN 107834180 A 3/2018

*Primary Examiner* — Ab Salam Alkassim, Jr.
(74) *Attorney, Agent, or Firm* — Lando & Anastasi, LLP

(57) ABSTRACT

Phased array antenna systems with antenna elements having substrates with varying dielectric constants selected to reduce the self-return signal of corner elements in the array. In one example, a phase array antenna system includes a plurality of stacked-patch microstrip antenna elements arranged in a two-dimensional array, each stacked-patch microstrip antenna element of the plurality of stacked-patch microstrip antenna elements including a pair of conductive patches disposed above a ground plane on a dielectric substrate. The dielectric substrate of corner stacked-patch microstrip antenna elements in the array has a dielectric constant lower than a dielectric constant of the dielectric substrate of non-corner stacked-patch microstrip antenna elements in the array.

19 Claims, 8 Drawing Sheets

(56) References Cited

U.S. PATENT DOCUMENTS

| | | | | |
|---|---|---|---|---|
| 7,427,949 | B2 | 9/2008 | Channabasappa et al. | |
| 7,522,105 | B1 * | 4/2009 | LaComb | H01Q 1/28 343/700 MS |
| 10,162,040 | B1 * | 12/2018 | McKivergan | H01Q 21/205 |
| 10,424,847 | B2 * | 9/2019 | Isom | H01Q 9/0435 |
| 2003/0137456 | A1 * | 7/2003 | Sreenivas | H01Q 21/065 343/700 MS |
| 2004/0189527 | A1 * | 9/2004 | Killen | H01Q 9/0414 343/700 MS |
| 2013/0002491 | A1 * | 1/2013 | Sabielny | H01Q 9/0414 343/700 MS |
| 2017/0271762 | A1 * | 9/2017 | Ko | H01Q 21/065 |
| 2018/0337456 | A1 * | 11/2018 | Liu | H01Q 1/2283 |
| 2019/0115664 | A1 | 4/2019 | Veihl et al. | |
| 2019/0140348 | A1 | 5/2019 | Jafargholi et al. | |
| 2019/0363432 | A1 * | 11/2019 | Hayashi | H01Q 1/38 |
| 2020/0313282 | A1 * | 10/2020 | Jia | H01Q 21/08 |

* cited by examiner

PHASED ARRAY ANTENNA WITH EDGE-EFFECT MITIGATION

CROSS-REFERENCE TO RELATED APPLICATIONS

This application claims the benefit under 35 U.S.C. § 119(e) of U.S. Provisional Application No. 62/883,833 filed on Aug. 7, 2019 and titled "CORNER/EDGE EFFECT MITIGATION ON PHASED ARRAY ANTENNA BY 3-D PRINTING TECHNIQUE," which is herein incorporated by reference in its entirety for all purposes.

BACKGROUND

Phased array antenna systems are used in a wide variety of communications and remote sensing applications. Many desirable characteristics for these arrays, such as low cost, low profile, light weight, etc., can be achieved using printed antenna elements, referred to as microstrip or "patch" antennas, where flat conductive elements, such as monopole or dipole antenna elements, are arranged in a two-dimensional array spaced from a single essentially continuous ground plane by a dielectric sheet of uniform thickness. However, a problem that arises in such phased arrays is the so-called "edge effect" where the antenna elements on the edges, and particularly in the corners, of the array experience different impedance matching than those in the center portion of the array due to different levels of mutual coupling. The corner or edge effect on the phased array antenna aperture front degrades the array performance (e.g. power gain, sidelobe level, beam pointing error, etc.), and may even could be detrimental to the underlying electronics under high-power operation. Conventionally, the edge effect is addressed by either surrounding the aperture periphery of the array with "dummy" inactive antenna elements or adding an RF absorber material around the aperture. For example, in certain conventional structures, parasitic or "dummy" elements are arranged adjacent to the array of active elements to provide a uniform impedance to the active elements that are on the edges of the array of active antenna elements. This results in the elements at the edge of the array being surrounded by approximately the same impedances as elements in the center of the array, thus enabling the far-field patterns associated with the edge elements to be approximately the same as the far-field patterns associated with elements in the center of the array. However, these solutions have several drawbacks, including the requirement of additional real estate at the congested aperture front and additional manufacturing complexity cost, and may not be practical for certain applications.

SUMMARY OF THE INVENTION

Aspects and embodiments are directed to a microstrip-based phased array antenna system in which corner/edge effect mitigation is realized based upon self-match signal reduction at the corner/edge elements by employing lower dielectric constant substrate made by additive manufacturing techniques.

According to one embodiment, a phased array antenna system comprises a plurality of microstrip antenna elements arranged in a two-dimensional array with a first plurality of corner antenna elements, a second plurality of edge antenna elements, and a third plurality of central antenna elements, the third plurality of central antenna elements being surrounded by the first plurality of corner antenna elements and the second plurality of edge antenna elements, each microstrip antenna element including a conductive patch disposed on a dielectric substrate, wherein the dielectric substrates of the first plurality of corner antenna elements each has a first dielectric constant that is lower than a dielectric constant of the dielectric substrates of the second plurality of edge antenna elements and the third plurality of central antenna elements.

In one example, the dielectric substrate of each corner antenna element of the first plurality of corner antenna elements includes a frame structure having a plurality of cavities formed therein. The sizes of the plurality of cavities may vary laterally across the dielectric substrate. In one example, the sizes of the plurality of cavities decrease outwardly from a center of the dielectric substrate.

In another example, the dielectric substrates of the second plurality of edge antenna elements each has a second dielectric constant and the dielectric substrates of the third plurality of central antenna elements each has a third dielectric constant, the second dielectric constant being higher than the first dielectric constant, and the third dielectric constant being higher than the second dielectric constant.

In one example, the dielectric substrate is a multi-layer dielectric substrate, and the conductive patch includes a top patch disposed on a first surface of the multi-layer dielectric substrate and a bottom patch disposed within the multi-layer dielectric substrate below the top patch. Each microstrip antenna element may further include a ground plane disposed on a second surface of the multi-layer dielectric substrate below the bottom patch. Each microstrip antenna element may further include a waveport configured to couple RF signals into and out of the microstrip antenna element. In one example, the waveport includes an RF stripline feed and H-shaped open aperture on the ground plane.

In another example, the dielectric substrates of the first plurality of corner antenna elements each has a density that is lower than a density of the dielectric substrates of the second plurality of edge antenna elements and the third plurality of central antenna elements.

According to another embodiment, a phased array antenna system comprises a plurality of stacked-patch microstrip antenna elements arranged in a two-dimensional array, each stacked-patch microstrip antenna element of the plurality of stacked-patch microstrip antenna elements including a pair of conductive patches disposed above a ground plane on a dielectric substrate, wherein the dielectric substrate of corner stacked-patch microstrip antenna elements in the array has a dielectric constant lower than a dielectric constant of the dielectric substrate of non-corner stacked-patch microstrip antenna elements in the array.

In one example, the dielectric substrate of the corner stacked-patch microstrip antenna elements in the array has a density lower than a density of the dielectric substrate of the non-corner stacked-patch microstrip antenna elements in the array. In one example, the dielectric substrate of the corner stacked-patch microstrip antenna elements in the array includes a plurality of cavities arranged in a regular pattern laterally across the dielectric substrate. In another example, the sizes of the plurality of cavities decrease outwardly from a center of the dielectric substrate.

In another example, the dielectric substrate is a multi-layer dielectric substrate, and wherein the pair of conductive patches includes a top patch disposed on a first surface of the multi-layer dielectric substrate and a bottom patch aligned with the top patch and disposed within the multi-layer dielectric substrate between the top patch and the ground plane.

Still other aspects, embodiments, and advantages of these exemplary aspects and embodiments are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION

The recent emerging gallium nitride (GaN) based high power density microwave circuitry opens up new opportunities for advancing the technology of phased array antenna systems to greater performance. However, such a high power density scheme introduces various issues such as thermal distribution, heat dissipation, high voltage discharge, RF loss, etc., that must be addressed in the design concept. Further, as discussed above, the corner/edge effect on the phase array antenna aperture front degrades the array performance and this effect is even more significant in small-scale finite arrays, as may be implemented for newer, advanced mobile communications architectures, such as 5G or 5GE systems, for example. The conventional approaches of simply implementing RF absorber and/or "dummy/surrogate" elements around the peripheral of antenna aperture lead to manufacturing complexity and additional cost. Furthermore, the requirement for additional real estate to implement these approaches may be difficult, if not impractical, in applications where the installation space of the phased array antenna is limited.

Aspects and embodiments offer a simpler solution to mitigate the corner/edge effect using modulation of the dielectric constant of the antenna substrate using additive manufacturing ("3-D printing") techniques while retaining a flat surface over the entire antenna aperture front, as discussed further below.

Figure 1:
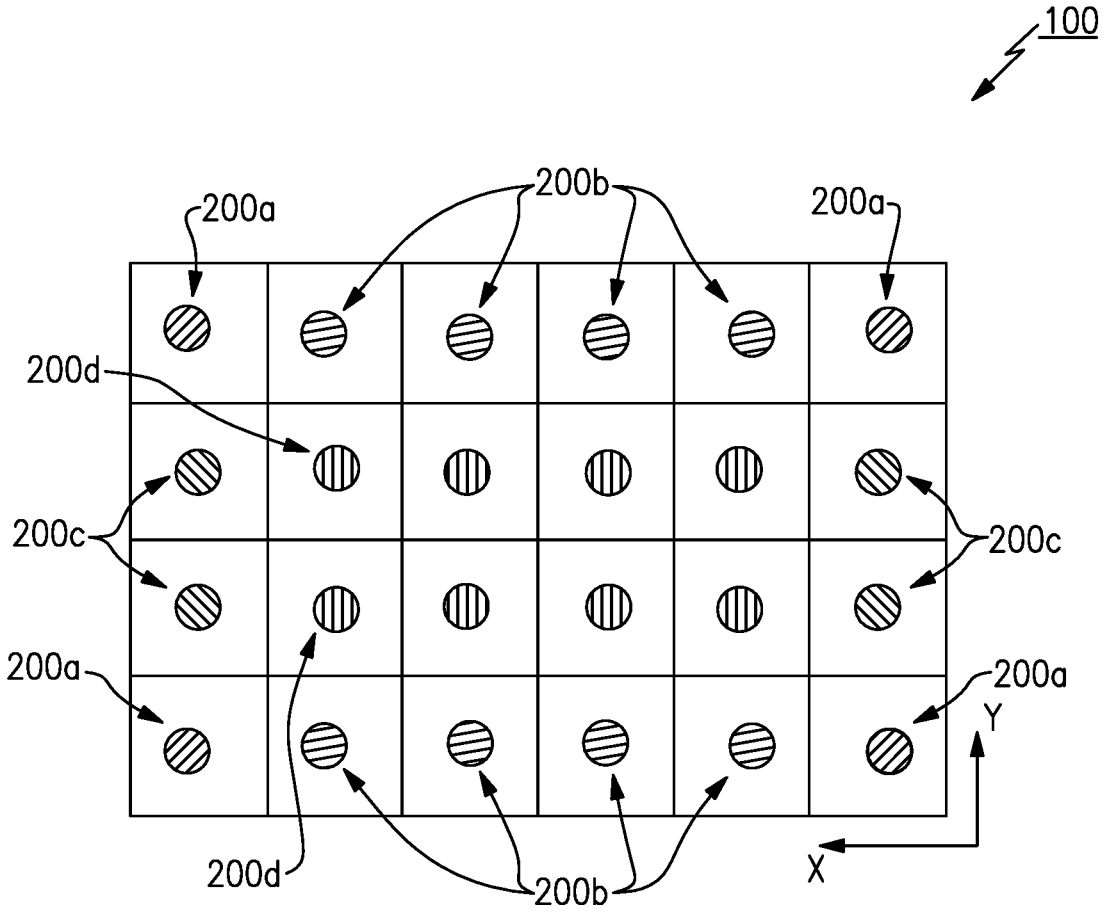
FIG. 1 is a block diagram showing a configuration of an example of an antenna array according to aspects of the present invention.

Referring to FIG. 1, there is illustrated an example of the configuration of a 6×4 antenna array 100, as may be used in S-band, for example, for the purposes of explanation. Each of the antenna elements 200 in the array may have the same or similar structure, but experience different mutual coupling and different effects based on their spatial positions within the array 100. In the illustrated example, antenna elements 200*a* are corner elements (there are 4 in the array 100), antenna elements 200*b* are horizontal edge elements (8 in the array), antenna elements 200*c* are vertical edge elements (4 in the array), and antenna elements 200*d* are interior elements (8 in the array). The example of the array 100 shown in FIG. 1 is a 6×4 array; however, those skilled in the art will appreciate, given the benefit of this disclosure, that the principles and techniques disclosed herein may be applied to arrays 100 of any size, not limited to a 6×4 configuration.

Figure 2:
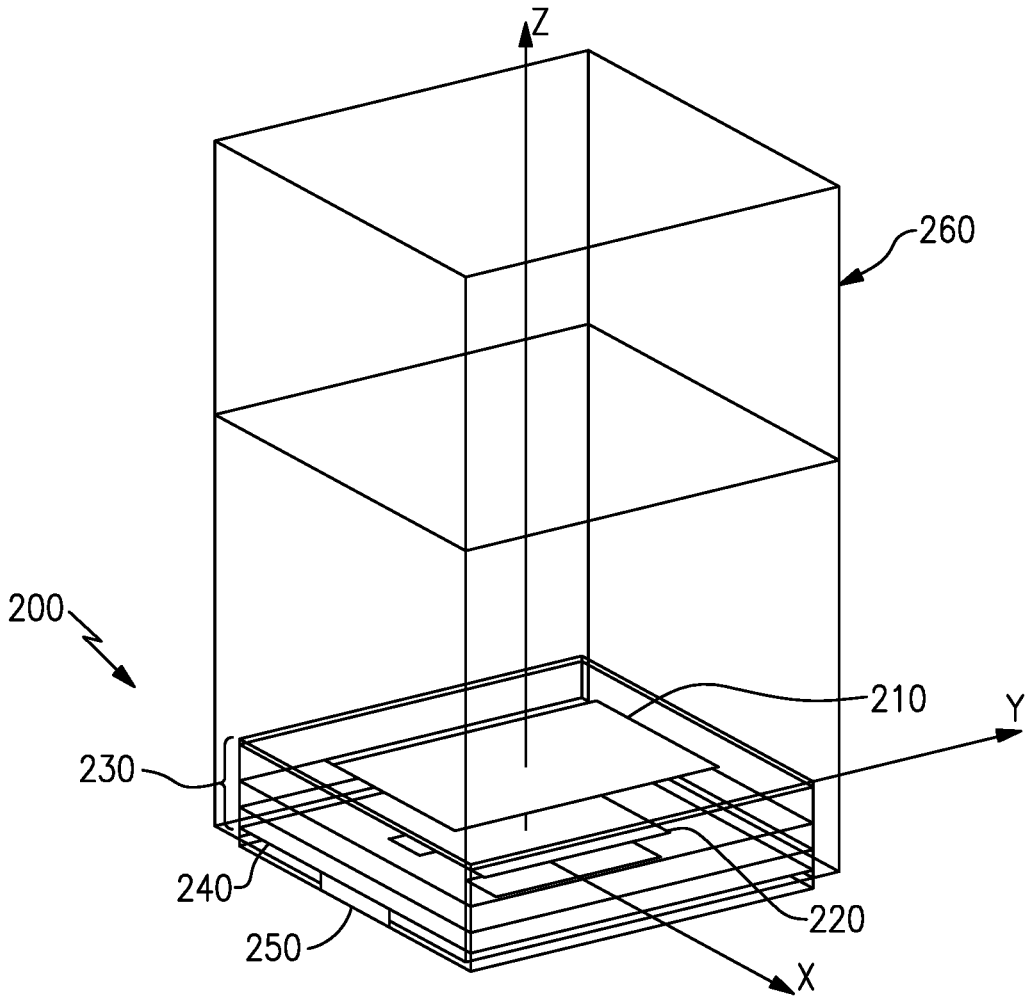
FIG. 2 is a diagram illustrating an example of a stacked patch radiator in an infinite array environment, according to aspects of the present invention.

According to certain embodiments, each antenna element 200 in the array has a stacked patch structure. FIG. 2 illustrates an example of a stacked patch radiator in an infinite array environment. The stacked patch element 200 includes a top patch 210 and a bottom patch 220 implemented in a multi-layer patch substrate 230 and positioned above a ground plane 240. The top patch 210 and bottom patch 220 operate in a complementary manner to produce the radiating beam pattern of the antenna element 200. Each of the top patch 210 and the bottom patch 220, as well as the ground plane 240, may be made of a printed conductive material, such as a copper layer, for example. In certain examples, the substrate 230 is made of CLTE-AT, a low-loss RF material that comprises a woven glass or polytetrafluoroethylene (PTFE) with micro-dispersed ceramics forming a composite laminate substrate having a dielectric constant of 3.0. The antenna element 200 includes a waveport 250, which in certain examples may be realized as an RF stripline feed and "H-shaped" open aperture on the ground plane, for coupling signals into and out of the radiating structure. In FIG. 2, the volume 260 illustrated above the antenna element 200 is solely for the purpose of finite element based simulation, as discussed further below.

As discussed above, in an array such as the array 100 shown in FIG. 1, the impedance characteristics of the different antenna elements 200*a-d* in the array may vary due to the positioning of the elements within the array structure. To illustrate, FIG. 3 shows a graph of the simulated reactive match performance of a sub-portion 110 (shown in FIG. 4)

of the array 100 implemented using antenna elements 200 of FIG. 2. Due to the symmetry of the array 100, a 3×2 sub-portion 110 with assigned symmetric boundaries in HFSS simulation is sufficient to represent the performance of the 6×4 example of the array 100. The data presented in FIG. 3 corresponds to the sub-array 110 shown in FIG. 4. For the simulation data presented in FIG. 3, the substrate 230 was simulated as being made of CLTE-AT with a dielectric constant of 3.0. As shown in FIG. 3, the HFSS simulation demonstrates that element-6, which is a corner antenna element 200*a*, exhibits poor matching performance in comparison with the other elements 1-5.

Figure 3:
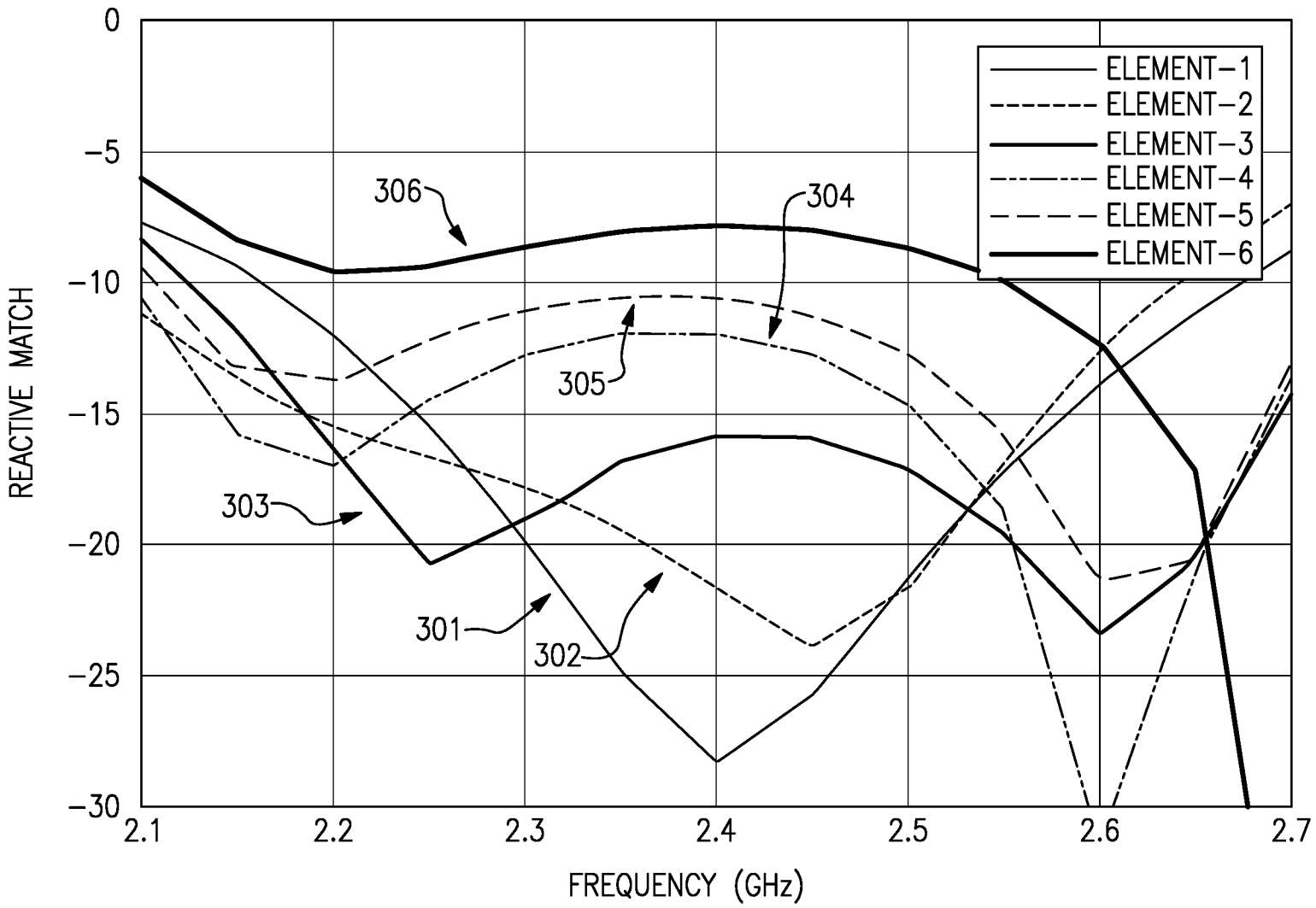
FIG. 3 is a graph of simulated reactive matching performance of a sub-portion of the antenna array of FIG. 1 (corresponding to FIG. 4) over a frequency range of 2.1-2.7 GHz.
Figure 4:
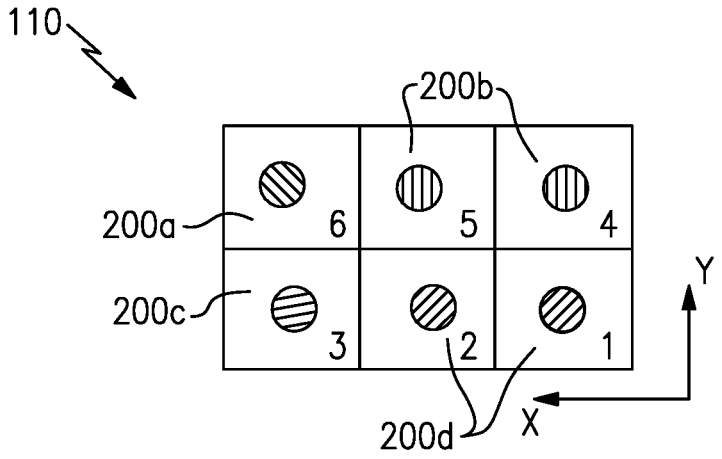
FIG. 4 is a block diagram of a sub-portion of the array 100 corresponding to the simulation data presented in FIG. 3.

FIG. 3 shows the simulated optimized reactive match data curve set of the six antenna elements of the sub-array 110 (FIG. 4) over a frequency range of 2.1-2.7 GHz by ANSYS HFSS simulation. Curve 301 corresponds to element-1 in the sub-array 110 of FIG. 4, curve 302 corresponds to element-2 in the sub-array 110 of FIG. 4, curve 303 corresponds to element-3 in the sub-array 110 of FIG. 4, curve 304 corresponds to element-4 in the sub-array 110 of FIG. 4, curve 305 corresponds to element-5 in the sub-array 110 of FIG. 4, and curve 306 corresponds to element-6 in the sub-array 110 of FIG. 4. The reactive match is defined as the return loss of the individual element when all the elements are excited simultaneously (i.e. a real operation condition). In other words, the reactive return signal is a vectorial sum of the self-return signal of the antenna element plus the incoming signals attributed to mutual coupling from all the surrounding antenna elements. Thus, a good match of any given antenna element in an array environment means that the self-match signal of that element is cancelled out by the total signal of all the mutual coupling. Under the circumstance of roughly identical radiator design across the entire aperture, the self-match of all the individual elements is about the same, while the total signal attributed to mutual coupling for each element is be different from element to element due to the non-symmetrical geometrical positions of the elements on the aperture. This may manifest as relatively poor reactive matching at the corner elements 200*a*, as shown by curve 306 in FIG. 3, and as discussed further below.

Figure 5B:
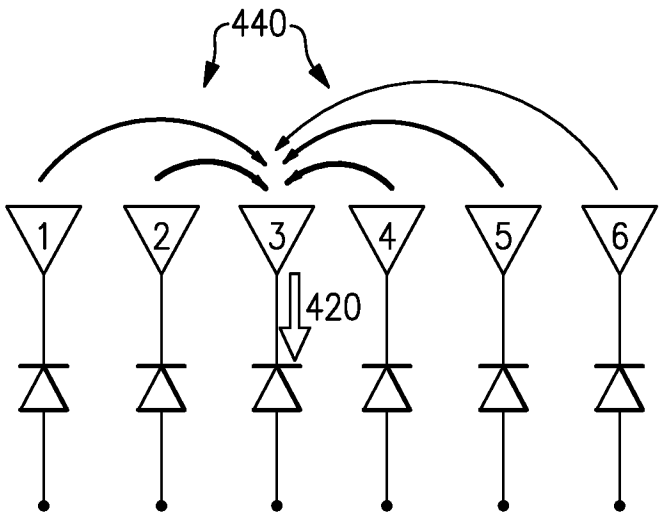
FIG. 5B is a diagram illustrating comparative mutual coupling to a central element in the 6×1 linear array.
Figure 5A:
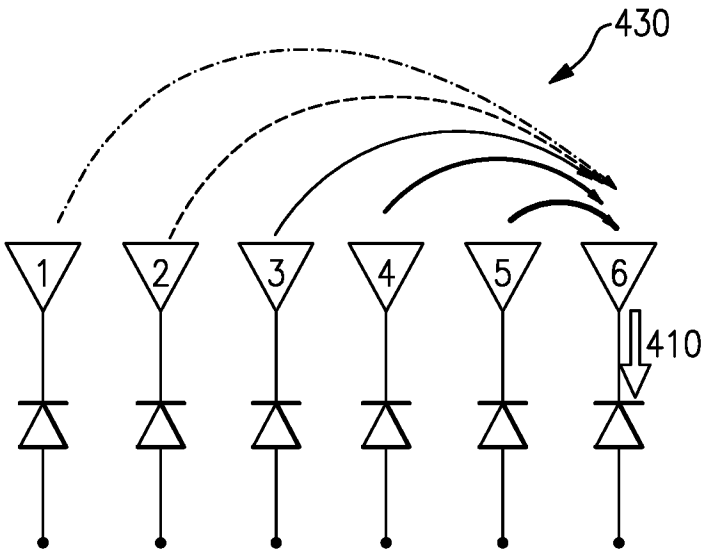
FIG. 5A is a diagram illustrating mutual coupling to a corner antenna element in a 6×1 linear array.

FIGS. 5A and 5B illustrate a simple example for explanation of the mutual coupling discussed above using a 6×1 linear array. FIG. 5A illustrates the active return signal (represented by the vectorial sum of arrow 410 and arrows 430) of element-6; and FIG. 5B illustrates, for comparison, the active return signal (represented by the vectorial sum of arrow 420 and arrows 440) of element-3. In a 6×1 linear array, the active return signals of element-6 and element-3 can be mathematically expressed in terms of S-parameters as follows:

$$\text{Active_return_element_6}=S(6,6)+S(6,5)+S(6,4)+S(6,3)+S(6,2)+S(6,1);$$

$$\text{Active_return_element_3}=S(3,6)+S(3,5)+S(3,4)+S(3,3)+S(3,2)+S(3,1);$$

S(6,6) and S(3,3) are so-called the "self-match" (or self-return signal) of element-6 and element-3 respectively, depicted as the arrows 410, 420 in FIGS. 5A and 5B, respectively. These two terms are about the same in terms of phase and amplitude due to the identical or similar design configuration of the corresponding antenna elements. All the other terms in the equations above are associated with mutual coupling, represented by the groups of arrows 430 and arrows of 440. The relative weight of each of the arrows in the groups 430 and 440 indicates the relative strength of the mutual coupling from the associated antenna element to element-6 (FIG. 5A) or element-3 (FIG. 5B). The amplitude and phase of the mutual coupling signal between two elements are closely associated with the geometrical separation distance between these two elements. The mutual coupling is stronger as such separation distance becomes closer, and vice versa.

As can be understood with reference to FIGS. 5A and 5B, the total coupling upon element-6 is very different than the corresponding total coupling on element-3. This results from the fact that element-3 abuts two nearest-neighbor elements in comparison with only one for element-6, and consequently the total mutual coupling on element-3 is significantly stronger than on element-6. As discussed above, superior reactive match performance relies on nearly perfect cancellation between the self-match and the mutual coupling. If full cancellation occurs at the central element (i.e., element-3 in this example), then at the corner element, the self-return signal is too large to cancel out the mutual coupling due to relatively weaker mutual coupling experienced by the corner element.

Thus, according to certain aspects and embodiments, mitigation of the edge/corner effect may be accomplished by reducing the self-return signal of corner and/or edge elements 200*a*-*c* in the array 100 in comparison with the central element(s) 200*d*. The diminished self-match signal may then be able to properly negate the relatively weaker mutual coupling signal experienced by the corner/edge elements. Based on simulations, according to certain embodiments, the desired self-return signal reduction may be effectively attained by employing a lower dielectric constant substrate/medium for the corner antenna elements 200*a* (and optionally the edge elements 200*b*, and/or 200*c*), while maintaining the same radiator profile level with all the other elements in the array 100 for maintenance convenience as well as radome flush mounting over the entire antenna aperture front.

Figure 6:
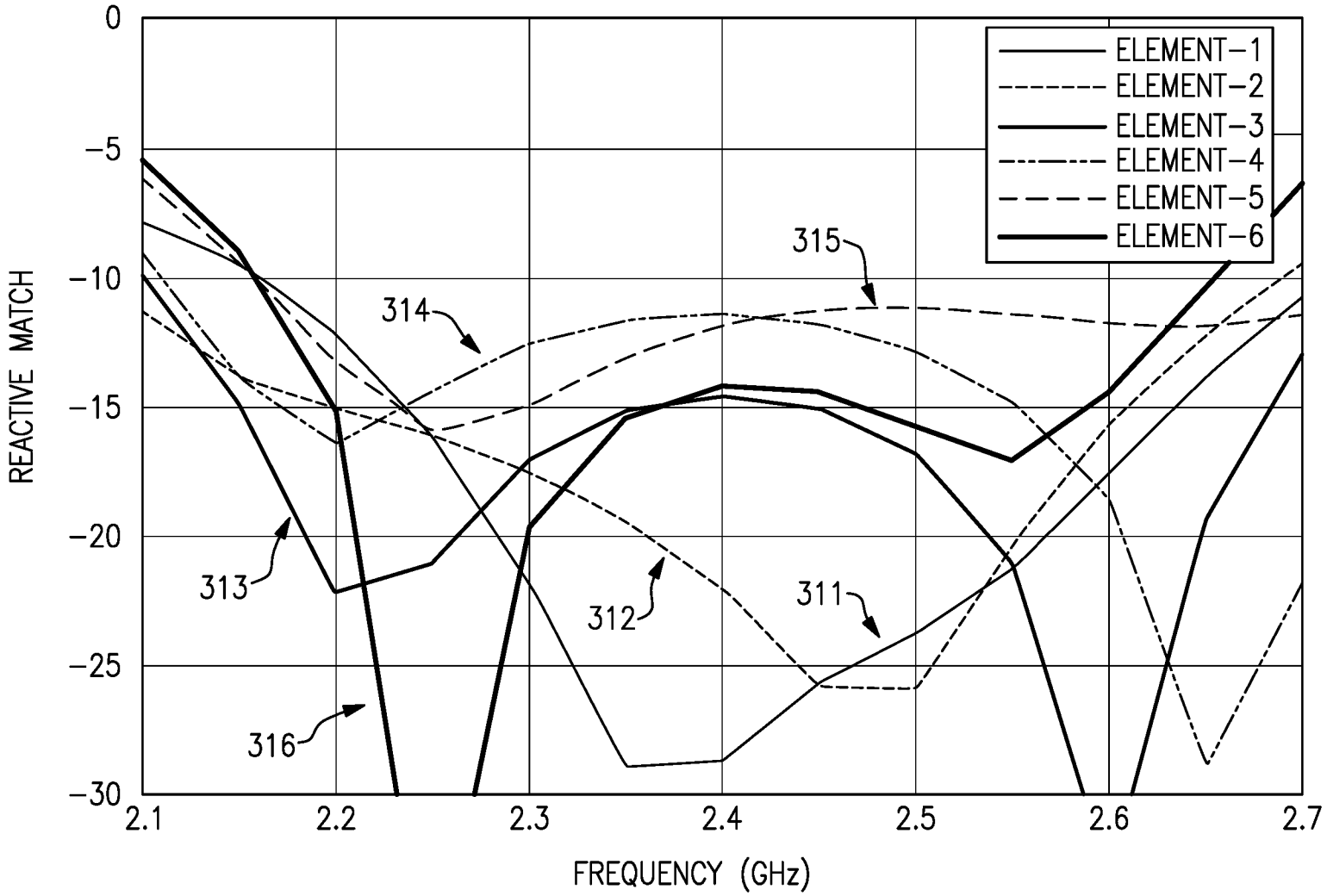
FIG. 6 is a graph of simulated reactive matching performance of the sub-portion of the antenna array of FIG. 4, modified according to certain aspects of the present invention, over a frequency range of 2.1-2.7 GHz.

FIG. 6 is a graph showing an example of a simulated optimized reactive match data curve set of the six antenna elements of the sub-array 110 (FIG. 4) over a frequency range of 2.1-2.7 GHz by ANSYS HFSS simulation, similar to FIG. 3. However, whereas for the simulation data presented in FIG. 3, each of the antenna elements 200 had the substrate 230 with the same dielectric constant of 3.0, for the simulation data shown in FIG. 6, the substrate 230 for the corner element (element-6 in FIG. 4) was modified. Specifically, in this example, the simulated substrate 230 for element-6 was an artificial material having a dielectric constant of 2.4. In FIG. 6, curve 311 corresponds to element-1 in the sub-array 110 of FIG. 4, curve 312 corresponds to element-2 in the sub-array 110 of FIG. 4, curve 313 corresponds to element-3 in the sub-array 110 of FIG. 4, curve 314 corresponds to element-4 in the sub-array 110 of FIG. 4, curve 315 corresponds to element-5 in the sub-array 110 of FIG. 4, and curve 316 corresponds to element-6 in the sub-array 110 of FIG. 4. As may be seen by comparing FIGS. 3 and 6, lowering the dielectric constant of the substrate 230 used for element-6 achieves a significant improvement in terms of the impedance matching of the corner element 220*a* (compare curve 316 in FIG. 6 with curve 306 in FIG. 3).

Figure 7A:
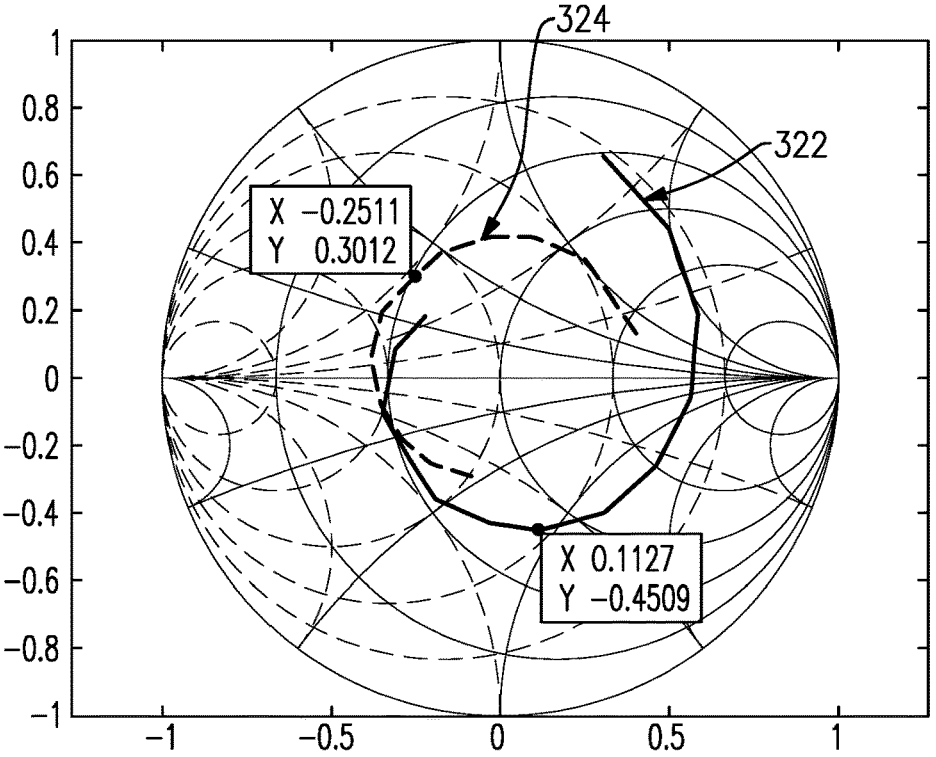
FIG. 7A is a Smith chart showing simulated impedance matching data for an example of the sub-array of FIG. 4.
Figure 7B:
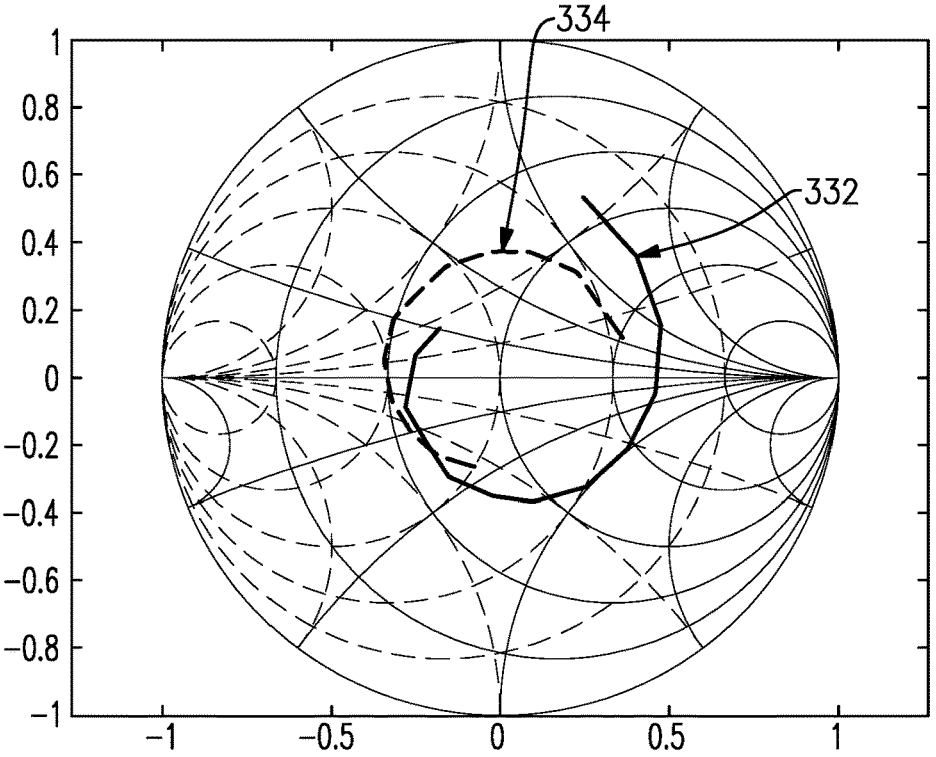
FIG. 7B is a Smith chart showing simulated impedance matching data for another example of the sub-array of FIG. 4, according to aspects of the present invention.

The matching improvement achieved by using a substrate 230 with lower dielectric constant than that of the substrates used in the other elements for the corner element 200*a* is further demonstrated by comparing FIGS. 7A and 7B. FIGS. 7A and 7B are Smith charts showing the simulated self-match (solid lines 322, 332) versus the simulated total mutual coupling signal (dashed lines 324, 334) for examples of the sub-array 110 of FIG. 4. FIG. 7A shows data of the corner element 200*a* for an example of the sub-array 110 in which all six antenna elements 200 were simulated with the substrate 230 having a dielectric constant of 3.0 (corresponding to the simulation data presented in FIG. 3). FIG. 7B shows data of the corner element 200*a* for an example of the sub-array 110 in which five of the six antenna elements 200 (elements 1-5) were simulated with the substrate 230 having a dielectric constant of 3.0 and the corner antenna element 200*a* (element-6) was simulated with the substrate 230 having a dielectric constant of 2.4 (corresponding to the simulation data presented in FIG. 6). As can be seen with reference to FIGS. 7A and 7B, the use of a lower dielectric constant substrate applied at the corner element 200*a* can reduce the self-return signal of the corner element, manifested by the size reduction of the impedance locus 332 in FIG. 7B in comparison with 322 in FIG. 7A.

In the simulation example discussed above, the dielectric constant of the substrate of the corner element 200*a* (element-6) was lowered, while the other five elements had the substrates with the same dielectric constant. In other examples, the dielectric constant of the substrates used for the horizontal edge elements 200*b* and/or the vertical edge elements 200*c*. In certain examples, using additive manufacturing techniques as discussed below, the dielectric constants of the substrates used for the corner and edge antenna elements 200*a-c* may be tailored to account for the varying levels of mutual coupling experienced at the different array positions. For example, if the central antenna elements 200*d* have a substrate 230 with a "base" or "starting point" dielectric constant, $D_0$, the horizontal edge elements 200*b* and/or vertical edge elements 200*c* can have substrates with a lower dielectric constant ($D_e<D_0$, for example), and the corner elements 200*a* can have substrates with an even lower dielectric constant ($D_c<D_e<D_0$, for example) to account for the fact that the corner elements 200*a* experience the lowest level of mutual coupling. In certain examples, depending on the configuration of the array 100, the horizontal edge elements 200*b* may experience different levels of mutual coupling than do the vertical edge elements 200*c*. In other examples, certain ones of the edge elements (whether horizontal edge elements 200*b* or vertical edge elements 200*c*) may experience different levels of mutual coupling than do other edge elements. In such and similar cases, the edge elements 200*b*, 200*c* need not all have substrates with the same dielectric constant, $D_e$, but may instead have tailored, varying dielectric constants to account for the different levels of mutual coupling experienced.

Figure 8A:
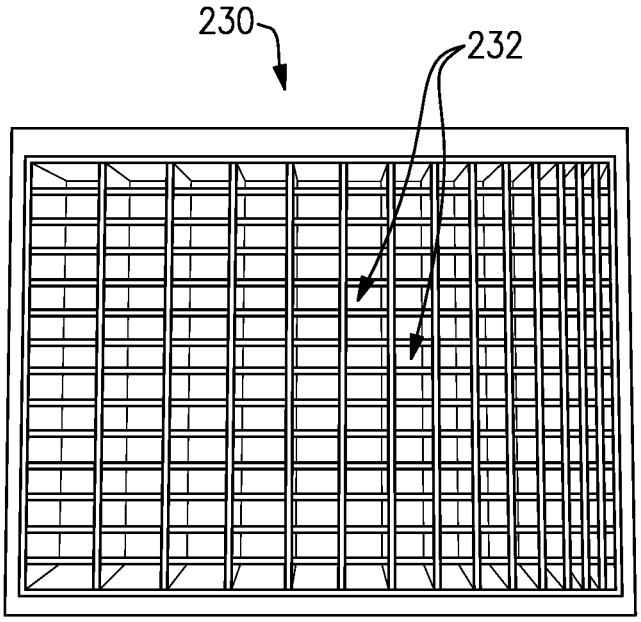
FIG. 8A is a top view of one example of a substrate for antenna elements in a phase array antenna system according to aspects of the present invention.
Figure 8B:
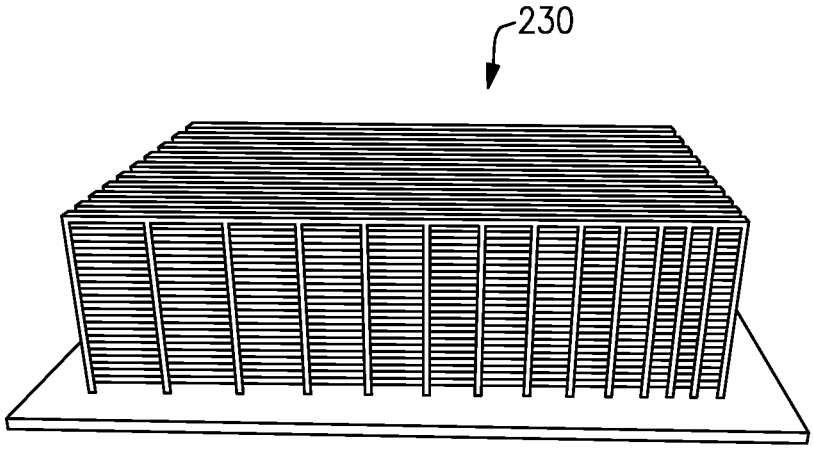
FIG. 8B is a side perspective view of the substrate of FIG. 8A.

According to certain embodiments, the lower dielectric substrate material used for the corner elements 200*a* can be realized by an additive manufacturing ("3-D printing") technique at precision. FIGS. 8A and 8B illustrate an example of the substrate 230 that can be used according to certain embodiments. FIG. 8A is a top view of the example of the substrate 230, and FIG. 8B is a corresponding side perspective view. According to certain embodiments, the density distribution of the substrate 230 can be manipulated by introducing air cavities 232 or voids to form a lattice-type structure, as shown in FIGS. 8A and 8B. Density variation, thus dielectric constant modulation, can be made quickly, conveniently and precisely by 3-D printing, whereas conventional manufacturing processes, such as milling, for example, are slow, waste material (and are therefore costly), may lack precision, and may be difficult or impractical to implement in certain circumstances. Using an additive manufacturing process, the substrate density can be manipulated by the cavity and/or voids formation via frame structuring, as illustrated in FIG. 8A and FIG. 8B, within the sample, for example. As a result, the process consumes the materials in a most effective way with minimum compromise of the mechanical rigidity of the substrate 230. In certain other examples, the density distribution of the substrate 230 can be manipulated by controlling the 3-D printing speed.

In certain examples, the substrate 230 can be configured during the additive manufacturing processes such that the resultant macroscopic density varies laterally across the substrate. For example, the substrate density may be lowest in the middle, while slowly increasing outwardly. In certain examples, this can be achieved by varying the sizes and/or spacing of the cavities 232 formed in the substrate 230. For example, referring to FIG. 8A, the cavities 232 can be largest in the middle of the substrate, while decreasing in size towards the edges, as shown. Thus, the amount of air introduced is higher in the middle than at the edges, thereby lowering the density (and dielectric constant) more in the middle than at the edges. Such a configuration may offer several advantages over the homogeneous substrates typically employed, such as surface wave depression, and elimination of charge accumulation on the boundary across heterogeneous substrate materials, for example. While such synthetic substrates are difficult to manufacture by traditional methods, the flexibility of additive manufacturing allows for structurally complex configurations to be easily and quickly produced to high precision.

Referring again to FIG. 2, in certain examples the substrate structure shown in FIGS. 8A and 8B, or variations thereof, may be used for one or more of the layers of the multi-layer substrate 230. For example, a cavity structure may be formed in the substrate layer that is between the top patch 210 and the bottom patch 220 to laterally vary the density, as discussed above. Alternatively, or in addition, a cavity structure may be formed in the substrate layer that is between the bottom patch 220 and the ground plane 240. In examples in which both layers of the substrate 230 include cavity patterns, those patterns may be the same or different, and may be selected to optimize the performance of the antenna element 200 in the array in which it is to be used. In further examples, the macroscopic density and/or dielectric constant of any one or more of the layers of the multi-layer substrate 230 may be varied using a technique other than frame structuring. For example, as the multi-layer substrate 230 is formed by additive manufacturing, different materials, having different densities and/or dielectric constants, can be printed in different regions of the substrate 230 and/or selected for different antenna elements. In addition, certain low-loss RF materials can be printed in a form having a porous foam structure, to lower the density thereof. The flexibility of additive manufacturing approaches allows any of these techniques and materials to be applied in any of the antenna elements 200 in an array to produce a phases array having improved or optimized performance through the mitigation of the corner/edge effect, as discussed above. Further, these improvements can be obtained while allowing the phased array to maintain the same profile level across all the antenna elements, which may be desirable for maintenance convenience as well as radome flush mounting over the entire antenna aperture front. In addition, the phased array antenna may be capable of operating over the same bandwidth with corner/edge effect mitigation applied. That is, no loss in operating bandwidth may be caused by applying corner/edge effect mitigation according to the techniques and approaches disclosed herein.

Thus, aspects and embodiments, provide a phase array antenna system that includes corner/edge effect mitigation through the use of substrates with different dielectric constants in the various patch antenna elements making up the array, with the dielectric constant being selected or tailored depending on the individual antenna element positioning within the array. Thus, the dielectric constant can be modulated based on spatial positioning with the phased array to precisely tune the self-match signals of the various antenna elements based on the level of mutual coupling experienced at different array positions. In certain examples, depending (for example) of the performance levels required for a given implementation of the phase array, the dielectric constant modulation can be applied to only a certain few of the antenna elements (e.g., only to the corner elements 200*a* where the edge effect is most significant), to a certain subset of the antenna elements (e.g., the corner elements 200*a* and at least some of the edge elements 200*b* and/or 200*c*), or may be tailored across the entire array. As discussed above, in certain embodiments, the tailored dielectric constant can be achieved by altering the density of the substrate(s) 230 using additive manufacturing techniques, which may offer several advantages. Unlike conventional corner/edge effect mitigation approaches that add RF absorber material or dummy/surrogate antenna elements and thereby add size, cost, and weight to the array, material dielectric constant modulation implemented through additive manufacturing may conveniently mitigate the corner/edge effect for small-scale finite phased array antennas without increasing the size of the array. In certain examples, introducing cavities or voids by a 3-D framing structure within the substrate lowers the density, and therefore the dielectric constant, while also enhancing mode purity with no material waste and only a minor compromise of mechanical rigidity. In addition, the additive manufacturing processes enable a smooth transition across hetero-structures to avoid charge accumulation. Using additive manufacturing, as discussed above, high-precision, mechanically robust, custom-tailored antenna elements and arrays may be created, optionally in small quantities, at reasonable cost, advantageously allowing the development of unique structures for particular applications.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, it is to be appreciated that embodiments of the methods and apparatuses discussed herein are not limited in application to the details of construction and the arrangement of components set forth in the foregoing description or illustrated in the accompanying drawings. The methods and apparatuses are capable of implementation in other embodiments and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation. Accordingly, the foregoing description and drawings are by way of example only, and the scope of the invention should be determined from proper construction of the appended claims, and their equivalents.

What is claimed is:

1. A phased array antenna system comprising:

a plurality of microstrip antenna elements arranged in a two-dimensional array with a first plurality of corner antenna elements, a second plurality of edge antenna elements, and a third plurality of central antenna elements, the third plurality of central antenna elements being completely surrounded by the first plurality of corner antenna elements and the second plurality of edge antenna elements, each microstrip antenna element including a conductive patch disposed on a dielectric substrate, wherein the dielectric substrates of all of the first plurality of corner antenna elements have a first dielectric constant that is lower than a dielectric constant of the dielectric substrates of the second plurality of edge antenna elements and the third plurality of central antenna elements.

2. The phased array antenna system of claim 1 wherein the dielectric substrate of each corner antenna element of the first plurality of corner antenna elements includes a frame structure having a plurality of cavities formed therein.

3. The phased array antenna system of claim 2 wherein sizes of the plurality of cavities vary laterally across the dielectric substrate.

4. The phased array antenna system of claim 3 wherein the sizes of the plurality of cavities decrease outwardly from a center of the dielectric substrate.

5. The phased array antenna system of claim 1 wherein the dielectric substrates of the second plurality of edge antenna elements each has a second dielectric constant and the dielectric substrates of the third plurality of central antenna elements each has a third dielectric constant, the second dielectric constant being higher than the first dielectric constant, and the third dielectric constant being higher than the second dielectric constant.

6. The phase array antenna system of claim 1 wherein the dielectric substrate is a multi-layer dielectric substrate, and wherein the conductive patch includes a top patch disposed on a first surface of the multi-layer dielectric substrate and a bottom patch disposed within the multi-layer dielectric substrate below the top patch.

7. The phased array antenna system of claim 6 wherein each microstrip antenna element further includes a ground plane disposed on a second surface of the multi-layer dielectric substrate below the bottom patch.

8. The phased array antenna system of claim 7 wherein each microstrip antenna element further includes a waveport configured to couple RF signals into and out of the microstrip antenna element.

9. The phase array antenna system of claim 8 wherein the waveport includes an RF stripline feed and H-shaped open aperture on the ground plane.

10. The phased array antenna system of claim 1 wherein the dielectric substrates of the first plurality of corner antenna elements each has a density that is lower than a density of the dielectric substrates of the second plurality of edge antenna elements and the third plurality of central antenna elements.

11. The phased array antenna system of claim 1, wherein the plurality of microstrip antenna elements comprise a plurality of stacked-patch microstrip antenna elements arranged in a two-dimensional array, each stacked-patch microstrip antenna element of the plurality of stacked-patch microstrip antenna elements including a pair of conductive patches disposed above a ground plane on a dielectric substrate.

12. The phased array antenna system of claim 11 wherein the dielectric substrate of the corner stacked-patch microstrip antenna elements in the array has a density lower than a density of the dielectric substrate of the non-corner stacked-patch microstrip antenna elements in the array.

13. The phased array antenna system of claim 12 wherein the dielectric substrate of the corner stacked-patch microstrip antenna elements in the array includes a plurality of cavities arranged in a regular pattern laterally across the dielectric substrate.

14. The phased array antenna system of claim 13 wherein sizes of the plurality of cavities decrease outwardly from a center of the dielectric substrate.

15. The phased array antenna system of claim 11 wherein the dielectric substrate is a multi-layer dielectric substrate, and wherein the pair of conductive patches includes a top patch disposed on a first surface of the multi-layer dielectric substrate and a bottom patch aligned with the top patch and disposed within the multi-layer dielectric substrate between the top patch and the ground plane.

16. The phased array antenna system of claim 1, wherein the first dielectric constant of the first plurality of corner elements is less than any dielectric constant of the second plurality of edge elements, the dielectric constant of any of the second plurality of edge elements being less than any dielectric constant of the third plurality of central elements.

17. The phased array antenna system of claim 1, wherein the first plurality of corner antenna elements includes four corner antenna elements.

18. The phased array antenna system of claim 1, wherein the first plurality of corner antenna elements includes all of the corner antenna elements.

19. The phased array antenna system of claim 1, wherein all of the first plurality of corner elements have substantially the same dielectric constant.

* * * * *